United States Patent [19]

Buurman et al.

[11] Patent Number: 4,487,510

[45] Date of Patent: Dec. 11, 1984

[54] MIXING APPARATUS

[75] Inventors: Cornelis Buurman; Arnon Plaschkes, both of Amsterdam, Netherlands

[73] Assignee: Shell Oil Company, Houston, Tex.

[21] Appl. No.: 589,864

[22] Filed: Mar. 19, 1984

Related U.S. Application Data

[63] Continuation of Ser. No. 476,742, Mar. 18, 1983, abandoned.

[30] Foreign Application Priority Data

May 28, 1982 [GB] United Kingdom ..... 8215708

[51] Int. Cl.[3] ..... B01F 5/06

[52] U.S. Cl. ..... 366/337; 138/37; 138/43

[58] Field of Search ..... 48/180 M, 180 B; 138/37, 39, 43; 366/285, 297, 336, 337, 338, 339, 340, 349; 521/917

[56] References Cited

U.S. PATENT DOCUMENTS

| | | | |
|---|---|---|---|
| 1,568,410 | 1/1926 | Minter | 48/189.4 |
| 2,613,143 | 10/1952 | Malouf | 366/336 |
| 3,452,762 | 7/1969 | Fahre | 138/43 |
| 4,300,552 | 11/1981 | Cannon | 138/43 |

FOREIGN PATENT DOCUMENTS 504549 2/1976 U.S.S.R. .

*Primary Examiner*—Robert W. Jenkins
*Assistant Examiner*—Arthur D. Dahlberg

[57] ABSTRACT

Mixing apparatus comprising an elongated vessel provided with a plurality of mixing guides rotatably mounted in the vessel, to obtain an optimal mixing of materials over a wide range of flow velocities without an inadmissible pressure drop over the vessel.

9 Claims, 2 Drawing Figures

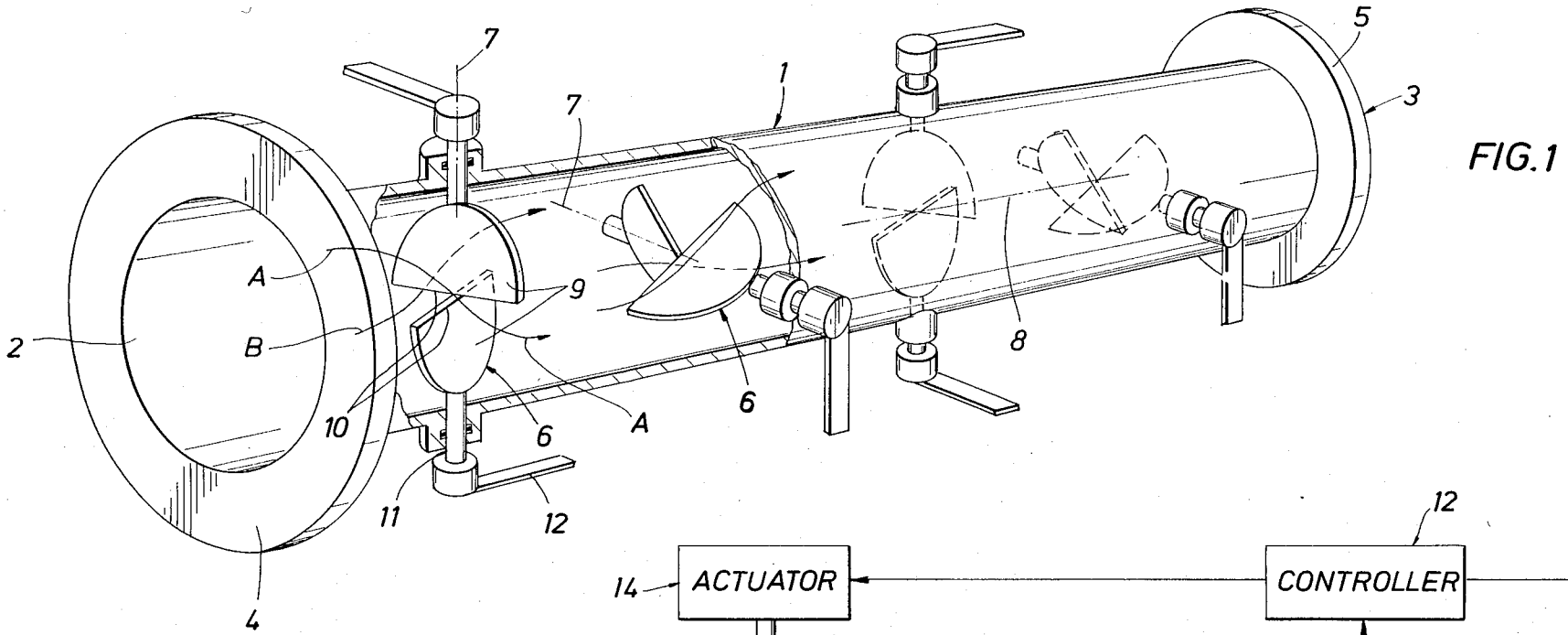
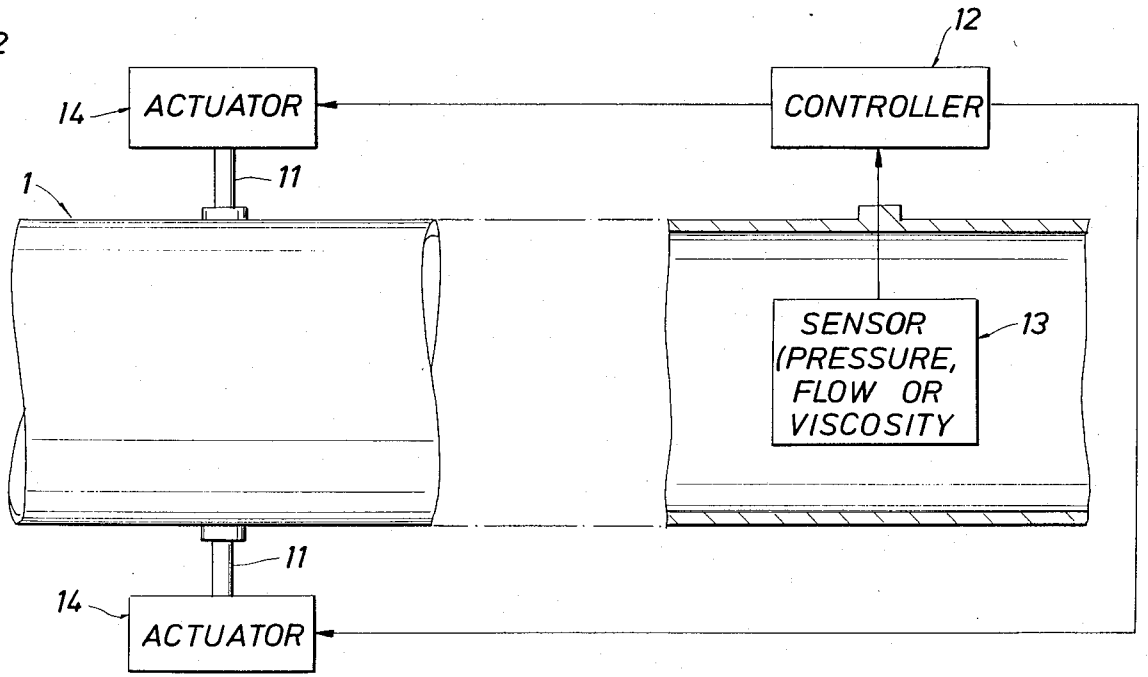
FIG. 2

MIXING APPARATUS

This is a continuation of application Ser. No. 476,742, filed Mar. 18, 1983, now abandoned.

BACKGROUND OF THE INVENTION

The invention relates to an apparatus for mixing two or more flowable materials to obtain a uniform mixture. Materials which may be mixed include liquids, gases, or finely divided solids. The invention relates in particular to a mixing apparatus having an elongated shape and provided internally with a plurality of baffles which interfere with and cause turbulence in the flow in the apparatus.

Mixing apparatus of the above type is widely applied for a great variety of purposes, such as the production of uniform mixtures of liquids, gases, and finely divided solids, and the production of compounds, such as, for example, resins from reactive liquids.

Upon flowing materials through such an apparatus, the baffles constitute obstructions in the flow, which obstructions cause turbulence in the flowing material, resulting in mixing of the various components in the flowing material. Dependent on the compositions of the materials, the result of flowing through the apparatus may be a uniform mixture, or it may be a compound if the components in the flow are reactive with one another.

Increase of the turbulence in the flow is, however, accompanied by an increase of the pressure drop over the mixing apparatus.

In the usual mixing apparatuses of the above type, the baffles are fixedly mounted in the passage for the flow, and may have various shapes, such as for example the shape of a spiral. These known mixing apparatus are sometimes called static mixers.

A consequence of the application of fixedly mounted baffles is a limitation on the range of applicability of a static mixer, as discussed below. It is this limitation that is avoided by the present invention.

At low flow velocities in a static mixer, of the usual sort, the resistance caused by the baffles will be rather low, so that turbulence of the flow (and therefore uniform mixing) will not readily occur, especially with rather viscous materials. On the other hand, at high flow velocities wherein the velocity itself generates turbulence in the flow, the baffles are not needed to contribute to the turbulence. Further, the resistance caused by the baffles as such high velocities easily becomes so great that the pressure drop over the mixing apparatus increases dramatically. Such a high pressure drop will cause a decrease of the pumping capacity of the supply pump(s) resulting in a lower capacity of the mixer.

SUMMARY OF THE INVENTION

The object of the present invention, therefore, is to provide an apparatus for mixing two or more flowing materials, wherein optimal mixing can be obtained at a wide range of flow velocities without an inadmissable pressure drop over the apparatus.

The apparatus for mixing two or more materials according to the invention comprises an elongated vessel having a longitudinal axis, and provided with at least one inlet means for supplying material to be mixed and outlet means for discharging material, the vessel being internally provided with a plurality of mixing baffles, axially spaced apart from one another, each baffle having a longitudinal axis arranged substantially perpendicular to the longitudinal axis of the vessel, wherein each baffle is rotatably mounted in the vessel.

As the baffles are rotatably mounted in the vessel according to the invention, the position of the baffles can be adjusted to the flow velocity and to the characteristics of the fluids passing through the vessel. In this manner an intense mixing can be obtained at relatively low flow velocities, whereas at high velocities the pressure drop over the vessel can be reduced by repositioning the baffles. Thus the range of applicability of such a mixer is significantly extended.

BRIEF DESCRIPTION OF THE DRAWING

The invention will be further elucidated by way of example with reference to the accompanying drawing where:

FIG. 1 shows an isometric projection of a mixing apparatus according to the invention.

FIG. 2 is a schematic representation of a mixer according to the invention provided with non-manual controls.

DESCRIPTION OF A PREFERRED EMBODIMENT

The mixing apparatus shown in the drawing comprises an elongated cylindrical vessel 1 being open at both ends to form an inlet 2 and an outlet 3. The vessel is further provided with flanges 4 and 5 for connecting the vessel to (for example) a non-shown pipeline system.

The interior of the vessel 1 is provided with a plurality of baffles 6 distributed over the length of the vessel 1. The baffles 6 have longitudinal axes 7 substantially perpendicular to the longitudinal axis 8 of the vessel 1. Preferably, these axes 7 are not parallel to each other; in the example shown, each axis 7 is staggered 90 degrees with respect to adjacent ones.

The baffles 6 each comprise two blade-shaped, semicircular elements or vanes 9, rotatably connected to each other at their flat ends 10. The vanes 9 are each provided with a rod-shaped element 11 passing through an opening in the wall of the vessel 1. The free ends of the rod-shaped elements 11 are provided with means 12 for rotation of the vanes 9. In this embodiment the means 12 are shown as handles; it should be understood (as will be discussed below) that other means of rotation may be used. It should be noted that the central axes of the rod-shaped elements 11 of each baffle 6 coincide with the longitudinal axis 7 thereof.

Upon passing of a flow of materials introduced via inlet 2 through the interior of the vessel 1, the flow is divided into two streams A and B due to the obstructions formed by the vanes 9 of each baffle 6. The part of the flow stream reaching the upper vane 9 of a vertically-arranged baffle 6 is deflected in a downward and clockwise direction (stream A), whereas the part of the flow reaching the lower vane 9 is deflected in an upward and counterclockwise direction (stream B). Upon passing through the openings between the flat ends of the vanes 9, streams A and B are forced together resulting in a mixing of the components of streams A and B with one another. When passing each further baffle 6 the flow is again split and redirected causing further mixing and redistribution over the cross section of the vessel 1.

In other words the presence of the baffles 6, forming obstructions to the flow, causes turbulence in the flow, so that the components in the flow are intensively mixed.

When the flow velocity in the vessel is rather low and/or the components of the flow are rather viscous so that the incoming flow tends to remain substantially laminar and can only with difficulty be made turbulent, the vanes 9 are set nearly perpendicular to the general direction of flow, resulting in substantial re-direction of flow and the generation of turbulence, thereby achieving the desired mixing at low flow rates.

When the flow velocity in the vessel is rather high and/or the components flowing are less viscous, so that the incoming material may already be in turbulence, or easily caused to be turbulent, the vanes are not required to contribute much to the turbulence. Under this condition the vanes 9 are repositioned in such a manner that they hardly form obstructions to the flow, so that the pressure drop over the vessel 1 due to the baffles 6 is kept relatively low. Thus, the mixer can remain effective at higher flow rates without being limited to pressure drop.

In the most extreme case the vanes 9 are arranged parallel to the main flow direction in the vessel, so that the flow is not hindered by these vanes. In this case the vanes 9 of each baffle 6 are aligned with each other.

The number of baffles 6 applied in the vessel 1 and the length of vessel 1 depend on the purpose for which the apparatus is intended to be used, as is readily understood by those familiar with the art. When the apparatus is applied for mixing reactive materials to obtain a compound, the required contact time between the materials determines the length of the vessel. The number of baffles in any application is determined by the flow properties of the fluids, more baffles being required for flows which are made turbulent only with difficulty.

The invention is not restricted to a vessel with a single common inlet as shown in the drawing. Instead the vessel may be provided with separate inlets for the various materials to be mixed in the vessel.

Instead of baffles 6 composed of two vanes 9 as shown in the drawing, the vessel may be equipped with baffles composed of only one or more than two vanes. It should, however, be noted that the shown construction of the baffles is advantageous over the alternatives, since this construction is rather simple compared to more than two vanes and yields a better mixing of materials than do baffles consisting of only one vane.

In the embodiment of FIG. 1 the baffles are manually rotatable. The rotation of the baffles can be readily mechanized and/or automated as shown in FIG. 2. To this end the baffles may, for example, be activated by a control device 12 coupled to a flow, pressure drop, and/or viscosity measuring device 13. The control devices chosen for a particular application are a matter of choice for designers familiar with such systems.

We claim as our invention:

1. An apparatus for mixing flowing materials comprising:

an elongated vessel provided with at least one inlet means near one end of said vessel for supplying materials to be mixed, and outlet means near the other end of said vessel for discharging the said materials after mixing; and a plurality of mixing guides inside said vessel, said mixing guides being spaced apart from each other along the longitudinal axis of said vessel, each of said guides having an axis arranged substantially perpendicular to the said longitudinal axis of said vessel, and each said guide being rotatably mounted in said vessel whereby materials flowed through the vessel are mixed by passing through and between said guides, and the pressure drop across the vessel is controlled by adjusting the angular position of said guides, each of said mixing guides including mounting rod means having at least one rod end extending through the wall of said elongated vessel in a rotatable and fluidtight manner, the axis of the rod ends being arranged substantially perpendicular to said longitudinal axis of said vessel, a second rod end being anchored to the wall of the vessel opposite said first rod end, sealing means affixed to said vessel and engaging at least the end of the first rod in a fluidtight manner, and at least two blade-shaped semicircular vanes each having a float or straight section formed on the periphery or outer edge thereof, said flat sections being rotatably connected together, the curved edges of the two vanes at points taken along a line perpendicular to said straight vane section being fixedly connected to the rod ends extending into said vessel, at least one vane being connected to a rod end for independent rotatable movement therewith, the combined area the pair of said two vanes being less than the cross-sectional area of said vessel whereby at least one of the vanes can rotate through a complete circle within the vessel.

2. The apparatus of claim 1 wherein said mixing guides are arranged with their said axes staggered at angles no greater than 180° relative to each other in parallel cross-sectional planes taken across the vessel.

3. The apparatus of claim 2 wherein each of the rod ends and the vanes which may be rotated and is provided with a rod-shaped element passing through an opening in the wall of said vessel, and said rod-shaped element is provided with rotating means outside said vessel.

4. The apparatus of claim 2 wherein said rotating means is a handle.

5. The apparatus of claim 2 wherein said rotating means is a non-manual actuator.

6. The apparatus of claim 2 wherein said actuator is controlled by flow-measuring means.

7. The apparatus of claim 2 wherein said actuator is controlled by viscosity-measuring means.

8. The apparatus of claim 2 wherein said actuator is controlled by pressure-measuring means.

9. The apparatus of claim 1 including rotating means operatively connected to the ends of the rod ends outside the vessel for rotating said rod ends about axis thereof to a selected position.

* * * * *